US008707730B2

(12) United States Patent
Prim

(10) Patent No.: US 8,707,730 B2
(45) Date of Patent: Apr. 29, 2014

(54) CONDITIONING AN ETHANE-RICH STREAM FOR STORAGE AND TRANSPORTATION

(75) Inventor: Eric Prim, Midland, TX (US)

(73) Assignee: Alkane, LLC, Houston, TX (US)

( * ) Notice: Subject to any disclaimer, the term of this patent is extended or adjusted under 35 U.S.C. 154(b) by 964 days.

(21) Appl. No.: 12/632,422

(22) Filed: Dec. 7, 2009

(65) Prior Publication Data

US 2011/0132033 A1 Jun. 9, 2011

(51) Int. Cl.
*F25J 3/00* (2006.01)

(52) U.S. Cl.
USPC ..... 62/618; 62/611; 62/613; 62/617; 62/619; 62/620

(58) Field of Classification Search
USPC ..... 62/617, 611, 613, 618–638
See application file for complete search history.

(56) References Cited

U.S. PATENT DOCUMENTS

| | | | | |
|---|---|---|---|---|
| 3,020,723 | A | 2/1962 | DeLury et al. | |
| 3,136,135 | A | 6/1964 | Rigby et al. | |
| 3,232,725 | A | 2/1966 | Secord et al. | |
| 3,298,805 | A | 1/1967 | Secord et al. | |
| 3,344,583 | A | 10/1967 | Styring et al. | |
| 3,735,600 | A | 5/1973 | Dowdell et al. | |
| 3,760,597 | A | 9/1973 | Becker | |
| 3,877,240 | A | 4/1975 | Kniel et al. | |
| 4,256,476 | A * | 3/1981 | Van Baush | 62/612 |
| 4,541,852 | A * | 9/1985 | Newton et al. | 62/613 |
| 4,846,863 | A | 7/1989 | Tomlinson et al. | |
| 5,615,561 | A | 4/1997 | Houshmand et al. | |
| 5,900,515 | A | 5/1999 | Mallinson et al. | |
| 5,950,453 | A | 9/1999 | Bowen et al. | |
| 6,023,942 | A | 2/2000 | Thomas et al. | |
| 6,217,626 | B1 | 4/2001 | Morris et al. | |
| 6,595,048 | B1 | 7/2003 | Drube et al. | |
| 6,604,380 | B1 | 8/2003 | Reddick et al. | |
| 6,941,771 | B2 | 9/2005 | Reddick et al. | |

(Continued)

FOREIGN PATENT DOCUMENTS

| | | | |
|---|---|---|---|
| JP | 2002106799 | A | 4/2002 |
| WO | 2007091916 | A1 | 8/2007 |

OTHER PUBLICATIONS

Martin Transport webpage http://www.martintransport.com/tanks.php, Jul. 17, 2008 (via web.archive.org/).*

(Continued)

*Primary Examiner* — Allen Flanigan
*Assistant Examiner* — Antonio R Febles
(74) *Attorney, Agent, or Firm* — Conley Rose, P.C.; Grant Rodolph

(57) ABSTRACT

A process comprising receiving an ethane-rich stream comprising at least about 70 molar percent ethane, conditioning the ethane-rich stream to a temperature such that the ethane-rich stream has a vapor pressure similar to the vapor pressure of conventional liquefied natural gas (LNG), and transporting the conditioned ethane-rich stream. Included is a plurality of processing equipment configured to implement a process comprising receiving an ethane-rich stream, adjusting a temperature, a pressure, or both of the ethane-rich stream such that the ethane-rich stream has a temperature from about −160° F. to about 0° F. and a pressure from about 14.7 pounds per square inch absolute (psia) to about 100 psia, and removing substantially all of any vapor fraction from the ethane-rich stream.

29 Claims, 2 Drawing Sheets

(56) References Cited

U.S. PATENT DOCUMENTS

| | | | | |
|---|---|---|---|---|
| 7,137,260 | B2 | 11/2006 | Perry | |
| 7,418,822 | B2 | 9/2008 | Perry | |
| 2002/0042550 | A1* | 4/2002 | Pironti et al. | 585/800 |
| 2003/0014995 | A1 | 1/2003 | Bowen et al. | |
| 2004/0237580 | A1 | 12/2004 | Mak | |
| 2005/0126220 | A1 | 6/2005 | Ward | |
| 2006/0042312 | A1 | 3/2006 | Winningham | |
| 2006/0076076 | A1 | 4/2006 | Darling, IV et al. | |
| 2006/0137391 | A1 | 6/2006 | Baudat et al. | |
| 2006/0254290 | A1* | 11/2006 | Michalski et al. | 62/101 |
| 2007/0130991 | A1 | 6/2007 | Shipchandler et al. | |
| 2008/0000265 | A1 | 1/2008 | Cuellar et al. | |
| 2008/0087041 | A1 | 4/2008 | Denton et al. | |
| 2008/0127654 | A1 | 6/2008 | Darling et al. | |
| 2008/0148742 | A1 | 6/2008 | Nierenberg | |
| 2008/0184735 | A1 | 8/2008 | van Wijngaarden et al. | |
| 2008/0190352 | A1 | 8/2008 | Lee et al. | |
| 2008/0264100 | A1 | 10/2008 | Mak et al. | |
| 2008/0302103 | A1 | 12/2008 | Minkkinen et al. | |
| 2009/0020537 | A1 | 1/2009 | Darling, IV et al. | |

OTHER PUBLICATIONS

Wood, David et al., "Natural Gas Interchangeability in Focus as Sources of LNG Widen," LNG Journal, Feb. 2007, pp. 14-18.

Xiao, Yaping, et al., "Global Budget of Ethane and Regional Constraints on U.S. Sources," Journal of Geophysical Research, vol. 113, 2008, 13 pages.

Ndao, Mohamed Julien, "The Dynmics of LNG Shipping Market and the Development of LNG Supply for Western Europe," Research Paper, 2004, 95 pages.

* cited by examiner

CONDITIONING AN ETHANE-RICH STREAM FOR STORAGE AND TRANSPORTATION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Natural gas refers to gaseous hydrocarbons that are produced from a subterranean formation. Natural gas comprises predominately methane ($CH_4$) with lesser amounts of ethane ($C_2H_6$), propane ($C_3H_8$), butane ($C_4H_{10}$), and perhaps a small amount of heavier hydrocarbons. Propane and heavier components ($C3^+$) tend to be separated from the natural gas, liquefied, and often sold as fuel for various purposes. The remaining methane and ethane, which may be liquefied to facilitate transportation and storage (e.g. as liquefied natural gas (LNG)) is often sold into a pipeline system as commercial natural gas.

In the United States, there are limits on the thermal potential energy, often referred to as the heating value, of commercial natural gas. Typically, commercial natural gas that is sold into a pipeline system is limited to a heating value of about 1,100 British Thermal Units per standard cubic foot (BTU/scf). Methane has a heating value of about 1,000 BTU/scf, whereas ethane has a heating value of about 1,700 BTU/scf. As a result, commercial natural gas is typically deethanated to meet the pipeline heating value limits. The deethanization process produces a substantial amount of ethane, which has little commercial value. In fact, many high-ethane content natural gas wells are shut-in (e.g. the natural gas is kept in the subterranean formation) because the cost of purifying the natural gas to meet the pipeline heating value specifications exceeds the value of the product streams. Additionally, gas may be shut in at the well because ethane extraction is necessary for the gas to meet pipeline specification, but there is no market for the extracted ethane.

SUMMARY

In one aspect, the disclosure includes a process comprising receiving an ethane-rich stream comprising at least about 70 molar percent ethane, conditioning the ethane-rich stream to a temperature such that the ethane-rich stream has a vapor pressure similar to the vapor pressure of conventional LNG, and transporting the conditioned ethane-rich stream.

In another aspect, the disclosure includes a plurality of processing equipment configured to implement a process comprising receiving an ethane-rich stream, adjusting a temperature, a pressure, or both of the ethane-rich stream such that the ethane-rich stream has a temperature from about −160° F. to about 0° F. and a pressure from about 14.7 pounds per square inch absolute (psia) to about 100 psia, and removing substantially all of any vapor fraction from the ethane-rich stream.

In a third aspect, the disclosure includes a plurality of processing equipment configured to implement a process comprising receiving an ethane-rich stream comprising at least about 90 molar percent ethane, conditioning the ethane-rich stream to a temperature from about −120° F. to about −40° F. and a pressure from about 20 psia to about 80 psia, and transporting the conditioned ethane-rich stream to a ship, a rail car, a storage tank, or combinations thereof.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a process and associated processing equipment for conditioning an ethane-rich stream for storage and/or transportation. A traditional gas processing plant separates a natural gas stream into a methane-rich stream, an ethane-rich stream, and a $C3^+$-rich stream. The ethane-rich stream is conditioned such that its vapor pressure is similar to that of LNG transported via LNG tanker ships. In specific embodiments, the conditioned ethane is loaded onto LNG tanker ships and transported to another location, such as Europe or the U.S. Gulf Coast, where more suitable markets for ethane exist.

Figure 1:
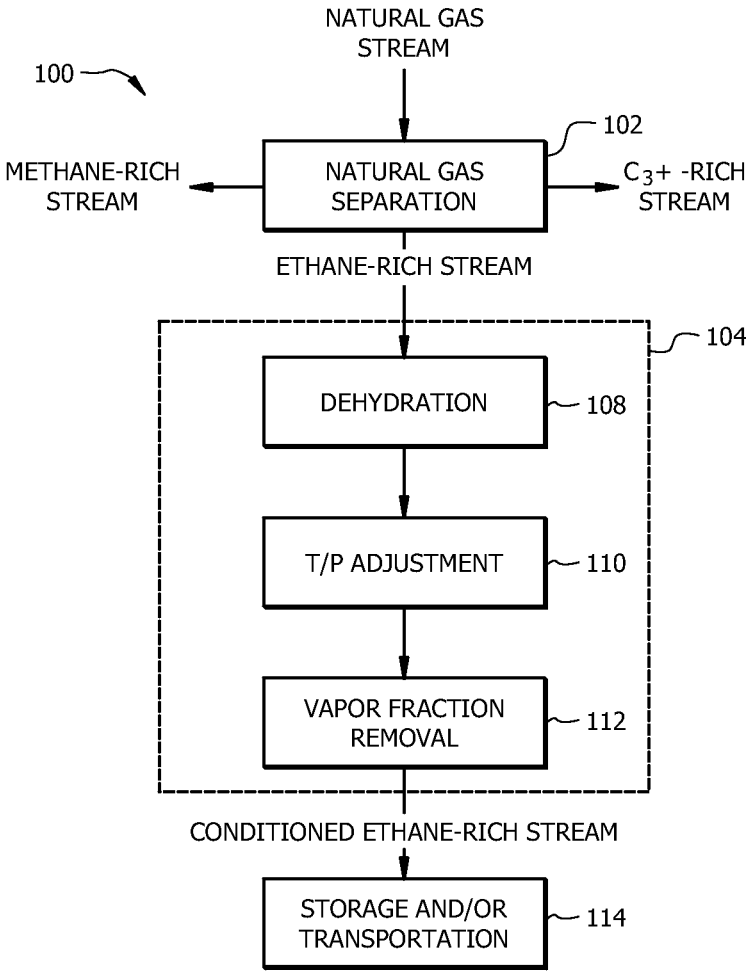
FIG. 1 is a schematic diagram of an embodiment of a natural gas treatment process.

FIG. 1 illustrates one embodiment of a natural gas treatment process 100. The natural gas treatment process 100 may receive a natural gas stream and implement a separation process 102 to separate the natural gas into a methane-rich stream, an ethane-rich stream, and a $C3^+$-rich stream. The ethane-rich stream then undergoes a conditioning process 104 in which the ethane-rich stream may be dehydrated 108, temperature and/or pressure adjusted 110, have its vapor fraction removed 112, or combinations thereof. The conditioned ethane-rich stream is then stored or transported 114 onto a LNG tanker ship for transportation to another location. Each of the aforementioned processes is described in further detail below.

Although the composition of the natural gas stream will vary from one location to another, the natural gas stream may comprise methane, ethane, propane, natural gas liquids (NGLs), heavy hydrocarbons, carbon dioxide ($CO_2$), hydrogen sulfide ($H_2S$), helium, nitrogen, water, or combinations thereof. The term "hydrocarbon" may refer to any compound comprising, consisting essentially of, or consisting of carbon and hydrogen atoms. The term "natural gas" may refer to any hydrocarbon that may exist in a gas phase under atmospheric or downhole conditions, and includes methane and ethane, but may also include diminishing amounts of C3-C8 hydrocarbons. The term "natural gas liquids" (NGLs) may refer to natural gases that may be liquefied without substantial refrigeration or pressurization, and may include C3-C8 hydrocarbons. Both natural gas and NGL are terms known in the art and may be used herein as such. In contrast, the term "heavy hydrocarbons" may refer to any hydrocarbon that may exist in a liquid phase under atmospheric or downhole conditions, and generally includes liquid crude oil, which may comprise $C9^+$ hydrocarbons, branched hydrocarbons, aromatic hydrocarbons, and combinations thereof. In embodiments, the natural gas stream may comprise from about 0.1 mole percent (mol %) to about 40 mol %, from about 1 mol % to about 20 mol %, from about 2 mol % to about 15 mol %, or from about 5 mol % to about 10 mol % ethane.

The natural gas may be separated into a methane-rich stream, an ethane-rich stream, and a $C3^+$-rich stream using a natural gas separation process 102. Methods for natural gas separation are known in the art, as evidence by U.S. Patent Application Publications 2003/0014995, 2006/0042312, 2006/0137391, 2008/0000265, 2008/0087041, all of which are incorporated herein by reference. While the aforementioned publications provide specific embodiments of natural gas processing methods, any suitable natural gas processing method may be used for the process described herein. In some embodiments, the natural gas separation process 102 may condition the methane-rich stream such that the methane-rich stream meets a heating value specification required for pipeline transportation. For example, the methane-rich stream may have an upper or gross heating value of no more than about 1,065 BTU/scf, no more than about 1,050 BTU/scf, or no more than about 1,000 BTU/scf. In embodiments, the methane-rich stream may comprise at least about 50 mol %, at least about 70 mol %, at least about 80 mol %, at least about 90 mol %, at least about 95 mol %, at least about 97 mol %, at least about 98 mol %, at least about 99 mol %, or may be substantially all methane. In embodiments, the $C3^+$-rich stream may comprise at least about 50 mol %, at least about 70 mol %, at least about 80 mol %, at least about 90 mol %, at least about 95 mol %, at least about 97 mol %, at least about 98 mol %, at least about 99 mol %, or may be substantially all $C3^+$.

The ethane-rich stream may comprise a substantial amount of ethane. For example, the ethane-rich stream may comprise at least about 50 mol %, at least about 70 mol %, at least about 80 mol %, at least about 90 mol %, at least about 95 mol %, at least about 97 mol %, at least about 98 mol %, at least about 99 mol %, or may be substantially all ethane. The remaining portion of the ethane-rich stream may also comprise various impurities, such as methane, $C3^+$, carbon dioxide, nitrogen, hydrogen sulfide, or combinations thereof. Typically, the natural gas separation process 102 produces a liquid ethane-rich stream. However, if such is not the case, the ethane-rich stream may be partially or completely liquefied prior to being conditioned.

If desired, the ethane-rich stream may be purified prior to being conditioned. Purification may be an optional step in which the ethane content of the ethane-rich stream is increased. In addition, any undesirable components (e.g., dust, carbon dioxide, hydrogen sulfide, or other hydrocarbons) may also be removed from the ethane-rich stream during purification. Purification may comprise any known hydrocarbon purification process. Such processes typically involve the use of distillation columns, knock-out drums, throttling valves, liquid-liquid extraction, or other separation means. In embodiments, the purification step may produce an ethane-rich stream comprising at least about 60 mol %, at least about 70 mol %, at least about 80 mol %, at least about 90 mol %, at least about 95 mol %, at least about 97 mol %, at least about 98 mol %, at least about 99 mol %, or may be substantially all ethane.

The ethane-rich stream may then be conditioned using a conditioning process 104. The conditioning process 104 may condition the ethane-rich stream such that the pressure and/or temperature of the conditioned ethane-rich stream is similar to a different type of hydrocarbon stream. For example, the conditioned ethane-rich stream may have a similar temperature and vapor pressure as LNG, compressed natural gas (CNG), NGLs, or any other type of hydrocarbons. In an embodiment, the conditioning process 104 may comprise dehydration 108, temperature and/or pressure adjustment 110, vapor fraction removal 112, or combinations thereof. While FIG. 1 illustrates one order of the dehydration 108, temperature and/or pressure adjustment 110, vapor fraction removal 112 steps, persons of ordinary skill in the art will appreciate that some or all of the dehydration 108, temperature and/or pressure adjustment 110, vapor fraction removal 112 steps may be implemented in any suitable order.

Dehydration 108 may be an optional step in which the water content of the ethane-rich stream is decreased. Dehydration 108 may comprise any known hydrocarbon dehydration process. Such processes typically involve the use of molecular sieves, glycol, refrigeration, solid desiccants, brines, phase separators, or combinations thereof. In embodiments, the dehydration 108 step may produce a conditioned ethane-rich stream comprising no more than about 5 mol %, no more than about 3 mol %, no more than about 2 mol %, no more than about 1 mol %, no more than about 0.5 mol %, no more than about 0.1 mol %, or be substantially of water.

Temperature and/or pressure adjustment 110 may be an optional step in which the temperature and/or pressure of the ethane-rich stream is adjusted to a point preferred for storage or transportation. Temperature and/or pressure adjustment 110 may comprise any known hydrocarbon temperature and/or pressure adjustment process. For example, the ethane-rich stream may be heated, cooled, compressed, throttled, expanded, or combinations thereof. Such processes typically involve the use of chillers, heaters, heat exchangers, compressors, pumps, throttling valves, turbines, or any other suitable apparatus to adjust the temperature and/or pressure of the ethane-rich stream. In embodiments, the temperature and/or pressure adjustment 110 may produce a conditioned ethane-rich stream having a temperature from about −160° F. to about 0° F., from about −120° F. to about −40° F., from about −100° F. to about −60° F., from about −90° F. to about −70° F., or about −80° F. In embodiments, the temperature and/or pressure adjustment 112 may produce a conditioned ethane-rich stream having a pressure from about 14.7 psia to about 100 psia, from about 20 psia to about 80 psia, from about 30 psia to about 70 psia, from about 40 psia to about 60 psia, or about 50 psia.

Vapor fraction removal 112 may be an optional step in which the vapor phase portion of the ethane-rich stream is substantially reduced or eliminated. Vapor fraction removal 112 may comprise any known hydrocarbon vapor fraction removal process. For example, the vapor fraction of the ethane-rich stream may be removed by separating the liquid and vapor portions of the ethane-rich stream in a phase separator or a knock-out drum. Alternatively, the ethane-rich stream may be liquefied by being cooled, compressed, or both. Such processes typically involve the use of chillers, compressors, pumps, or any other suitable apparatus to liquefy the ethane-rich stream. In embodiments, the vapor fraction removal 112 step may produce a conditioned ethane-rich stream comprising no more than about 5 mol % vapor, no more than about 3 mol % vapor, no more than about 2 mol % vapor, no more than about 1 mol % vapor, no more than about 0.5 mol % vapor, no more than about 0.1 mol % vapor, or be substantially free of vapor.

The conditioned ethane-rich stream may then be stored or transported 114. For example, the conditioned ethane-rich stream may be stored in a storage tank (e.g. an LNG storage tank), stored in a subterranean formation. The storage container may be insulated to minimize heat ingress and ethane boil-off. In some cases, the ethane storage container is equipped with a recycle system and a cooling system to re-liquefy the boiled-off ethane vapor. Alternatively or additionally, the conditioned ethane-rich stream may be transported using a pipeline, a truck, a rail car, or a tanker ship. In embodiments, the pipeline, truck, rail car, or tanker ship may be one that is normally configured to transport LNG, CNG, NGLs, or any other type of hydrocarbons, but due to the conditioning of the conditioned ethane-rich stream (e.g. the vapor pressure of the conditioned ethane being similar to the vapor pressure of the transported LNG, CNG, NGLs, or any other type of hydrocarbons), is able to transport the conditioned ethane-rich stream. For example, the conditioned ethane may be transported in LNG tankers or LNG carriers over water. In a specific embodiment, the conditioned ethane may be shipped from the East Coast of the United States to another location, such as Europe (e.g., The Netherlands, France, Denmark, or combinations thereof). In embodiments, the conditioned ethane-rich stream may be stored and/or transported under conditions (e.g. temperature and pressure) similar to the conditioned ethane-rich stream described above. The vessels that contain the conditioned ethane on the transport vehicles may be insulated to minimize heat ingress and ethane boil-off. In some cases, the transport vehicles may be equipped with recycle systems and cooling systems to re-liquefy the boiled-off ethane vapor.

In some cases, when the conditioned ethane arrives at the destination, it is offloaded and vaporized to be blended with a natural gas stream. For example, the temperature and/or pressure adjustment 110, the vapor fraction removal 112, or both may be implemented in reverse to obtain an effluent ethane-rich stream similar to the ethane-rich stream described above, but perhaps with greater ethane concentrations and lower water content. European limitations for commercial natural gas heating value are higher than the natural gas heating value limits in the United States. Thus, in some embodiments, the effluent ethane-rich stream may be processed such that it is suitable to be blended with a methane rich stream, such as the methane-rich stream described above, to produce a commercial natural gas stream having a heating value higher than the methane-rich stream. For example, the effluent ethane may be added to the methane-rich stream such that the combined stream may have a lower or net heating value of no more than about 1,100 BTU/scf, no more than about 1,150 BTU/scf, or no more than about 1,160 BTU/scf.

Figure 2:
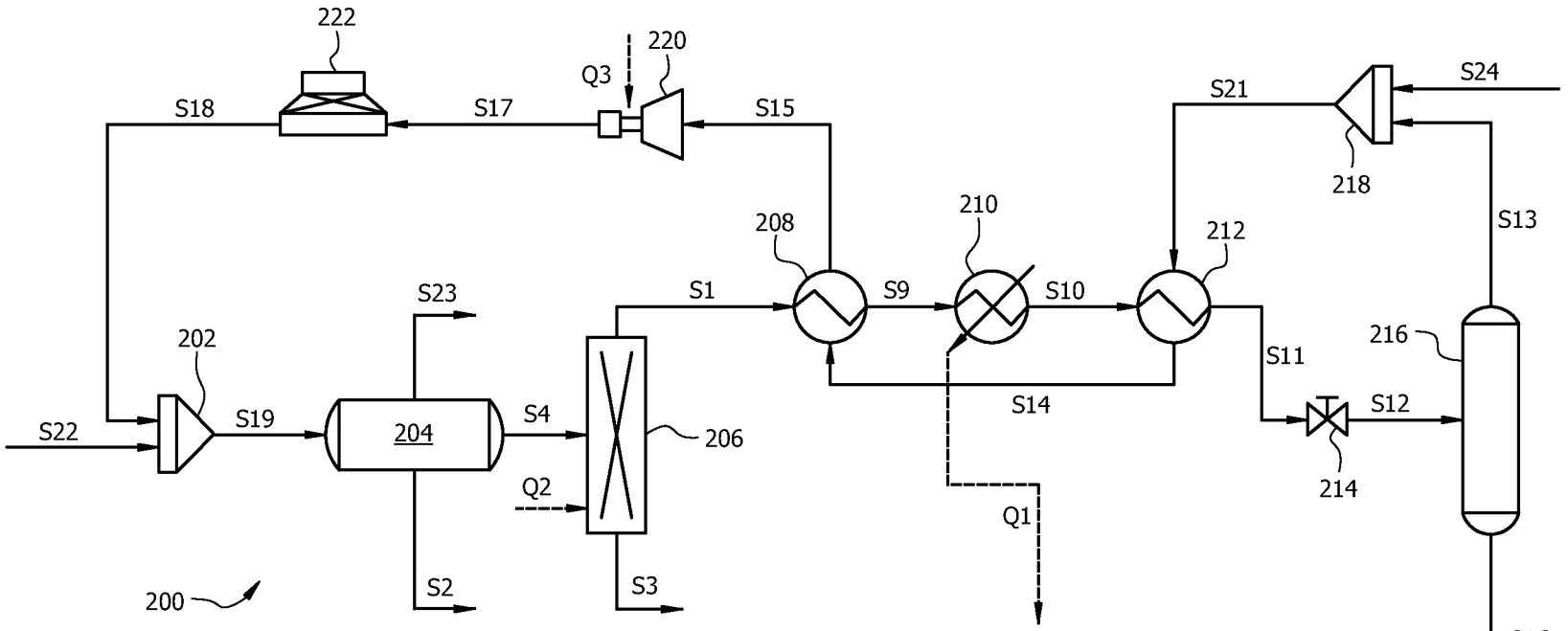
FIG. 2 is a process flow diagram for an embodiment of an ethane conditioning process.

FIG. 2 illustrates an embodiment of the ethane conditioning process 200 similar to the ethane conditioning process 104 described above. The ethane conditioning process 200 may receive a feed stream S22 that may be similar to the ethane-rich stream described above. The feed stream S22 may enter a mixer 202 and may be mixed with a second compressed ethane-rich stream S18 to produce a combined feed stream S19. The ethane conditioning process 200 may then implement a dehydration process. In an embodiment, the combined feed stream S19 may be sent to a separator 204 that removes a first water stream S2 from the combined feed stream S19, thereby producing a dried ethane-rich stream S4. In some cases, a gaseous hydrocarbon and/or water stream S23 may also be produced by the separator 204, for example when the separator 204 is a three-phase separator. The dried ethane-rich stream S4 may be further dehydrated in another separator 206, such as a dehydrator. Specifically, the separator 206 may use energy Q2, e.g. from a cooler, to separate a second water stream S3 from the dehydrated ethane-rich stream S1.

The ethane conditioning process 200 may then implement a temperature and/or pressure adjustment process. In an embodiment, the dehydrated ethane-rich stream 51 may be cooled and/or compressed, for example, by passing it through a first heat exchanger 208 to produce a first cooled ethane-rich stream S9. The first cooled ethane-rich stream S9 may be further cooled by passing it through a second heat exchanger 210, thereby producing a second cooled ethane-rich stream S10. Similarly, the second cooled ethane-rich stream S10 may be further cooled by passing it through a third heat exchanger 212, thereby producing a third cooled ethane-rich stream S11. It will be appreciated that the embodiment illustrated in FIG. 2 is only one example of a temperature and/or pressure adjustment process and that other devices and configurations having more of fewer heat exchangers may be used to cool and/or compress the dehydrated ethane-rich stream S1. The third cooled ethane-rich stream S11 may then pass through a valve 214 that further reduces the temperature and/or pressure of the ethane-rich stream, thereby producing a throttled ethane-rich stream S12.

The ethane conditioning process 200 may then implement a vapor removal process. In an embodiment, the throttled ethane-rich stream S12 may be sent to a separator 216, such as a knock-out drum, that removes an ethane-rich vapor stream S13 from the conditioned liquid ethane-rich stream S16. The conditioned liquid ethane-rich stream S16 may be the product stream and may be stored and/or transported as described herein.

In an embodiment, the ethane-rich vapor stream S13 may be used to cool the dehydrated ethane-rich stream S1, for example in heat exchangers 208, 210, and/or 212. In some embodiments, for example when the conditioned liquid ethane-rich stream S16 is being stored or loaded onto a LNG tanker ship, the tanker ship may produce an ethane-rich vapor return stream S24. In such cases, the ethane-rich vapor return stream S24 may be combined with the ethane-rich vapor stream S13 in a mixer 218. The resulting combined ethane-rich vapor stream S21 may pass through the third heat exchanger 212, thereby cooling the second cooled ethane-rich stream S10. The resulting warmed ethane-rich vapor stream S14 may then pass through the first heat exchanger 208, thereby cooling the dehydrated ethane-rich stream S1. The resulting second warmed ethane-rich vapor stream S15 may be sent to a compressor 220, which uses energy Q3 to compress the second warmed ethane-rich vapor stream S15 into a first compressed ethane-rich vapor stream S17. The first compressed ethane-rich vapor stream S17 may then be cooled in a fourth heat exchanger 222, for example an air cooler, to produce the second compressed ethane-rich vapor stream S18, which is combined with the feed stream S22 in the mixer 202.

In some cases, the energy output Q1 of the second heat exchanger 210 is absorbed by an external refrigeration system. The refrigeration fluid that circulates in the external refrigeration system may be any suitable refrigeration fluid, such as methane, ethane, propane, Freon, or combinations thereof. Alternatively, the heat exchange between the external refrigeration system and the first cooled ethane-rich stream S9 may occur via an intermediary fluid that flows between heat exchangers 210 and the external refrigeration system.

Each mixer 202, 218 described herein may either be a dynamic mixer or a static mixer. Dynamic mixers are mixers that employ motion or mechanical agitation to mix two or more streams. For example, a dynamic mixer may be a tank with a paddle operating either in a continuous or batch mode. In contrast, static mixers are mixers that do not employ any motion or mechanical agitation to mix two or more streams. For example, a static mixer may be a convergence of piping designed to combine two streams, such as a pipe tee, and may include one or a plurality of valves. Either type of mixer may be configured with internal baffles to promote the mixing of the feed streams.

The separators 204, 206, 216 may be any of a variety of process equipment suitable for separating a stream into two separate streams having different compositions, states, temperatures, and/or pressures. For example, one or more of the separators 204, 206, 216 may be a phase separator. A phase separator is a vessel that separates an inlet stream into a substantially vapor stream and a substantially liquid stream, such as a knock-out drum or a flash drum. Such vessels may have some internal baffles, temperature, and/or pressure control elements, but generally lack any trays or other type of complex internal structure commonly found in columns. Alternatively, one or more of the separators 204, 206, 216 may be a column having trays, packing, or some other type of complex internal structure. Examples of such columns include scrubbers, strippers, absorbers, adsorbers, packed columns, and distillation columns having valve, sieve, or other types of trays. Such columns may employ weirs, downspouts, internal baffles, temperature, and/or pressure control elements. Such columns may also employ some combination of reflux condensers and/or reboilers, including intermediate stage condensers and reboilers. Finally, one or more of the separators 204, 206, 216 may be any other type of separator, such as a membrane separator.

The heat exchangers 208, 210, 212, 222 described herein may be any of a variety of process equipment suitable for heating or cooling any of the streams described herein. Generally, heat exchangers 208, 210, 212, 222 are relatively simple devices that allow heat to be exchanged between two fluids without the fluids directly contacting each other. For example, the heat exchangers 208, 210, 212, 222 may be shell-and-tube, kettle-type, air cooled, hairpin, bayonet, and/or plate-fin heat exchangers. In the case of an air cooler, one of the fluids is atmospheric air, which may be forced over tubes or coils using one or more fans, similar to a convention radiator.

The compressor 220 described herein may be any of a variety of process equipment suitable for increasing the pressure, temperature, and/or density of any of the streams described herein. Generally, compressors are associated with vapor streams and pumps are associated with liquid streams; however such a limitation should not be read into the present processes as the compressors and pumps described herein may be interchangeable based upon the specific conditions and compositions of the streams. The types of compressors suitable for the uses described herein include centrifugal, axial, positive displacement, rotary, and reciprocating compressors and pumps. Finally, the ethane conditioning process 200 may contain additional compressors and/or pumps other than those described herein.

The valve 214 described herein may be a device configured to change the pressure and/or flow rate of the fluid stream passing through it. In embodiments, the valves 214 may be ball valves, gate valves, globe valves, angle valves, butterfly valves, diaphragm valves, plug cock valves, or combinations thereof. Persons of ordinary skill in the art will appreciate that the ethane conditioning process 200 may have additional valves not illustrated in FIG. 2.

The energy streams Q1, Q2, Q3 described herein represent energy that is added to or removed from the various components, and may be derived from any number of suitable sources. For example, heat may be added to a process stream using steam, turbine exhaust, or some other hot fluid and a heat exchanger. Similarly, heat may be removed from a process stream by using a refrigerant, air, or some other cold fluid and a heat exchanger. Further, electrical energy can be supplied to compressors, pumps, and other mechanical equipment to increase the pressure or other physical properties of a fluid. Similarly, turbines, generators, or other mechanical equipment can be used to extract physical energy from a stream and optionally convert the physical energy into electrical energy. Persons of ordinary skill in the art are aware of how to configure the processes described herein with the required energy streams Q1, Q2, Q3. In addition, persons of ordinary skill in the art will appreciate that the ethane conditioning process 200 may contain additional equipment, process steams, and/or energy streams other than those described herein.

EXAMPLE

A simulation of the ethane conditioning process was prepared using the process flow diagram in FIG. 2 as an example. The simulation was performed using the UniSim Design (R390 Build 15055) software package. In the simulation, all the ethane-rich streams comprise ethane as a majority component, no more than about 2 mol % of other hydrocarbons such as methane and/or propane, and no more than about 0.1 mol % of other impurities such as carbon dioxide and/or nitrogen. In addition, propane was used as the refrigerant in the external refrigeration system. The simulation results are presented below in Tables 1-3. The specified values are indicated by an asterisk (*). The physical properties are provided in degrees Fahrenheit (F), pounds per square inch (psia), million standard cubic feet per day (MMSCFD), barrel per day (barrel/day), pounds per hour (lb/hr), British thermal units per hour (Btu/hr), and British thermal units per pound mole (Btu/lb-mole). In the tables, Std Ideal Liq. Vol. Flow means standard ideal liquid volumetric flow.

Table 1A: Ethane Conditioning Process Stream Properties

| Property | S22 | S23 | S2 |
|---|---|---|---|
| Vapor Fraction | 0.0000 | 1.0000 | 0.0000 |
| Temperature (F.) | 80.00 * | 88.58 | 88.58 |
| Pressure (psia) | 1000 * | 1000 | 1000 |
| Molar Flow (MMSCFD) | 100.0 * | 0.0000 | 0.4291 |
| Mass Flow (lb/hr) | 41.50 | 0.0000 | 0.1070 |
| Std Ideal Liq. Vol. Flow (barrel/day) | 6.329e+04 | 0.0000 | 58.24 |
| Heat Flow (Btu/hr) | −4.503e+08 | 0.0000 | −5.812e+06 |
| Molar Enthalpy (Btu/lb-mole) | −4.101e+04 | −4.031e+04 | −1.233e+05 |

Table 1B: Ethane Conditioning Process Stream Properties

| Property | S4 | S9 | S10 |
|---|---|---|---|
| Vapor Fraction | 0.0000 | 0.0000 | 0.0000 |
| Temperature (F.) | 88.58 | 80.00 * | −30.00 * |

-continued

| | | | |
|---|---|---|---|
| Pressure (psia) | 1000 | 995.0 | 990.0 |
| Molar Flow (MMSCFD) | 121.5 | 121.5 | 121.5 |
| Mass Flow (lb/hr) | 50.45 | 50.43 | 50.43 |
| Std Ideal Liq. Vol. Flow (barrel/day) | 7.710e+04 | 7.709e+04 | 7.709e+04 |
| Heat Flow (Btu/hr) | −5.380e+08 | −5.411e+08 | −5.763e+08 |
| Molar Enthalpy (Btu/lb-mole) | −4.031e+04 | −4.057e+04 | −4.320e+04 |

Table 1C: Ethane Conditioning Process Stream Properties

| Property | S11 | S12 | S21 |
|---|---|---|---|
| Vapor Fraction | 0.0000 | 0.1646 | 1.0000 |
| Temperature (F.) | −33.00 * | −81.29 | −81.27 |
| Pressure (psia) | 985.0 | 50.00 * | 50.00 |
| Molar Flow (MMSCFD) | 121.5 | 121.5 | 22.00 |
| Mass Flow (lb/hr) | 50.43 | 50.43 | 9.065 |
| Std Ideal Liq. Vol. Flow (barrel/day) | 7.709e+04 | 7.709e+04 | 1.388e+04 |
| Heat Flow (Btu/hr) | −5.771e+08 | −5.771e+08 | −9.251e+07 |
| Molar Enthalpy (Btu/lb-mole) | −4.326e+04 | −4.326e+04 | −3.830e+04 |

Table 1D: Ethane Conditioning Process Stream Properties

| Property | S14 | S15 | S16 |
|---|---|---|---|
| Vapor Fraction | 1.0000 | 1.0000 | 0.0000 |
| Temperature (F.) | −53.28 | 54.91 | −81.29 |
| Pressure (psia) | 45.00 | 40.00 | 50.00 |
| Molar Flow (MMSCFD) | 22.00 | 22.00 | 101.5 |
| Mass Flow (lb/hr) | 9.065 | 9.065 | 42.19 |
| Std Ideal Liq. Vol. Flow (barrel/day) | 1.388e+04 | 1.388e+04 | 6.447e+04 |
| Heat Flow (Btu/hr) | −9.173e+07 | −8.863e+07 | −4.930e+08 |
| Molar Enthalpy (Btu/lb-mole) | −3.797e+04 | −3.669e+04 | −4.424e+04 |

Table 1E: Ethane Conditioning Process Stream Properties

| Property | S17 | S18 | S19 |
|---|---|---|---|
| Vapor Fraction | 1.0000 | 1.0000 | 0.0000 |
| Temperature (F.) | 449.7 | 120.0 * | 88.58 |
| Pressure (psia) | 1050 * | 1045 | 1000 |
| Molar Flow (MMSCFD) | 22.00 | 22.00 | 122.0 |
| Mass Flow (lb/hr) | 9.065 | 9.065 | 50.55 |
| Std Ideal Liq. Vol. Flow (barrel/day) | 1.388e+04 | 1.388e+04 | 7.715e+04 |
| Heat Flow (Btu/hr) | −7.562e+07 | −9.367e+07 | −5.439e+08 |
| Molar Enthalpy (Btu/lb-mole) | −3.130e+04 | −3.878e+04 | −4.061e+04 |

Table 1F: Ethane Conditioning Process Stream Properties

| Property | S1 | S3 |
|---|---|---|
| Vapor Fraction | 0.0000 | 0.0000 |
| Temperature (F.) | 87.00 * | 87.00 * |
| Pressure (psia) | 1000 | 1000 |
| Molar Flow (MMSCFD) | 121.5 | 6.886e−02 |
| Mass Flow (lb/hr) | 50.43 | 1.716e−02 |
| Std Ideal Liq. Vol. Flow (barrel/day) | 7.709e+04 | 9.346 |
| Heat Flow (Btu/hr) | −5.380e+08 | −9.329e+05 |
| Molar Enthalpy (Btu/lb-mole) | −4.033e+04 | −1.234e+05 |

Table 1G: Ethane Conditioning Process Stream Properties

| Property | S13 | S24 |
|---|---|---|
| Vapor Fraction | 1.0000 | 1.0000 |
| Temperature (F.) | −81.29 | −81.04 * |
| Pressure (psia) | 50.00 | 50.00 * |
| Molar Flow (MMSCFD) | 20.00 | 2.000 * |
| Mass Flow (lb/hr) | 8.239 | 0.8260 |
| Std Ideal Liq. Vol. Flow (barrel/day) | 1.261e+04 | 1264 |
| Heat Flow (Btu/hr) | −8.410e+07 | −8.415e+06 |
| Molar Enthalpy (Btu/lb-mole) | −3.830e+04 | −3.832e+04 |

TABLE 2

| Heat Flow Values | |
|---|---|
| Name | Heat Flow (Btu/hr) |
| Q1 | 3.520e+07 |
| Q2 | −8.862e+05 |
| Q3 | 1.301e+07 |

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having may be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A process comprising:

receiving an ethane-rich stream comprising at least about 70 molar percent ethane;

conditioning the ethane-rich stream to a temperature from about −160° F. to about 0° F.;

removing substantially all of a vapor fraction from the ethane-rich stream, wherein the vapor fraction is used to condition the ethane-rich stream;

combining the vapor fraction with the ethane-rich stream after the vapor fraction has conditioned the ethane-rich stream; and transporting the conditioned ethane-rich stream.

2. The process of claim 1, wherein the conditioned ethane-rich stream is transported in a liquefied natural gas (LNG) tanker ship or rail car.

3. The process of claim 2, wherein the ethane-rich stream comprises at least about 80 molar percent ethane, and wherein the conditioned ethane-rich stream has a pressure from about 14.7 pounds per square inch absolute (psia) to about 100 psia.

4. The process of claim 2, wherein the ethane-rich stream comprises at least about 90 molar percent ethane, wherein the temperature of the conditioned ethane-rich stream is from about −120° F. to about −40° F., and wherein the conditioned ethane-rich stream has a pressure from about 20 pounds per square inch absolute (psia) to about 80 psia.

5. The process of claim 2, wherein the ethane-rich stream comprises at least about 95 molar percent ethane, wherein the temperature of the conditioned ethane-rich stream is from about −100° F. to about −60° F., and wherein the conditioned ethane-rich stream has a pressure from about 30 pounds per square inch absolute (psia) to about 70 psia.

6. The process of claim 2, wherein the ethane-rich stream comprises at least about 97 molar percent ethane, wherein the temperature of the conditioned ethane-rich stream is from about −90° F. to about −70° F., and wherein the conditioned ethane-rich stream has a pressure from about 40 pounds per square inch absolute (psia) to about 60 psia.

7. The process of claim 2, wherein the ethane-rich stream comprises at least about 98 molar percent ethane, wherein the temperature of the conditioned ethane-rich stream is about −80° F., and wherein the conditioned ethane-rich stream has a pressure about 50 pounds per square inch absolute (psia).

8. A process comprising:

receiving an ethane-rich stream;

adjusting a temperature, a pressure, or both of the ethane-rich stream such that the ethane-rich stream has a temperature from about −160° F. to about 0° F. and a pressure from about 14.7 pounds per square inch absolute (psia) to about 100 psia;

removing substantially all of a vapor fraction from the ethane-rich stream, wherein the vapor fraction is used to adjust the temperature, the pressure, or both of the ethane-rich stream; and combining the vapor fraction with the ethane-rich stream after adjusting the temperature, pressure, or both of the ethane-rich stream.

9. The process of claim 8 further comprising:

removing substantially all of any liquid water; and subsequently removing substantially all of any water vapor.

10. The process of claim 8, wherein adjusting a temperature, a pressure, or both comprises:

passing the ethane-rich stream through a plurality of heat exchangers; and throttling the ethane-rich stream.

11. The process of claim 10, wherein at least one of the heat exchangers is serviced by an external refrigeration process.

12. The process of claim 10 further comprising:

receiving an ethane-rich vapor return stream from a storage tank, a transportation vessel, or both; and combining the ethane-rich vapor return stream with the vapor fraction, thereby producing an ethane-rich vapor stream, wherein the ethane-rich vapor stream is used to adjust the temperature, the pressure, or both of the ethane-rich stream.

13. The process of claim 12, wherein the ethane-rich stream is passed through a first heat exchanger, then a second heat exchanger, and then a third heat exchanger, wherein the second heat exchanger is serviced by an external refrigeration process, and wherein the ethane-rich vapor stream passes through the third heat exchanger, and then the first heat exchanger.

14. The process of claim 13, wherein the ethane-rich vapor stream is compressed, cooled, and combined with the ethane-rich stream after passing through the first heat exchanger.

15. The process of claim 14 further comprising:

receiving a natural gas stream; and separating the ethane-rich stream from the natural gas stream.

16. A process comprising:

receiving an ethane-rich stream comprising at least about 90 molar percent ethane;

conditioning the ethane-rich stream to a temperature from about −120° F. to about −40° F. and a pressure from about 20 pounds per square inch absolute (psia) to about 80 psia;

removing substantially all of a vapor fraction from the ethane-rich stream, wherein the vapor fraction is used to condition the ethane-rich stream;

combining the vapor fraction with the ethane-rich stream after the vapor fraction has conditioned the ethane-rich stream; and transporting the conditioned ethane-rich stream to a ship, a rail car, a storage tank, or combinations thereof.

17. The process of claim 16, wherein the ethane-rich stream comprises at least about 95 molar percent ethane, wherein the temperature is from about −100° F. to about −60° F., and wherein the pressure is from about 30 psia to about 70 psia.

18. The process of claim 16, wherein the ethane-rich stream comprises at least about 98 molar percent ethane, wherein the temperature is about −80° F., and wherein the pressure is about 50 psia.

19. The process of claim 18, wherein the ship is a liquefied natural gas (LNG) tanker destined for Europe or the U.S. Gulf Coast.

20. The process of claim 1, wherein conditioning the ethane-rich stream comprises:

passing the ethane-rich stream through one or more heat exchangers; and passing the vapor fraction through a last of the one or more heat exchangers prior to removing substantially all of the vapor fraction.

21. The process of claim 20, wherein conditioning the ethane-rich stream occurs before removing substantially all of any vapor fraction from the ethane-rich stream.

22. The process of claim 1, wherein the conditioned ethane-rich stream comprises no more than about 5 molar percent vapor.

23. The process of claim 8, wherein adjusting the temperature, the pressure, or both of the ethane-rich stream comprises:

passing the ethane-rich stream through one or more heat exchangers; and passing the vapor fraction through a last of the one or more heat exchangers prior to removing substantially all of the vapor fraction.

24. The process of claim 23, wherein adjusting the temperature, the pressure, or both of the ethane-rich stream occurs before removing substantially all of any vapor fraction from the ethane-rich stream.

25. The process of claim 8, wherein the adjusted ethane-rich stream comprises no more than 5 molar percent vapor.

26. The process of claim 8, wherein the ethane-rich stream comprises at least about 70 molar percent ethane.

27. The process of claim 16, wherein conditioning the ethane-rich stream comprises:

passing the ethane-rich stream through one or more heat exchangers; and passing the vapor fraction through a last of the one or more heat exchangers prior to removing substantially all of the vapor fraction.

28. The process of claim 27, wherein conditioning the ethane-rich stream occurs before removing substantially all of any vapor fraction from the ethane-rich stream.

29. The process of claim 16, wherein the conditioned ethane-rich stream comprises no more than 5 molar percent vapor.

* * * * *